US005165122A

United States Patent [19]

Phalen

[11] Patent Number: 5,165,122

[45] Date of Patent: Nov. 24, 1992

[54] BODY TRANSFER MAT HAVING OPPOSING SELECTIVELY ENGAGEABLE WING PORTIONS FOR SECURING A PATIENT

[76] Inventor: Paul J. Phalen, 3610 N. 61st St., Omaha, Nebr. 68104

[21] Appl. No.: 837,029

[22] Filed: Feb. 18, 1992

[51] Int. Cl.[5] ..... A61G 7/08

[52] U.S. Cl. ..... 5/81.1; 5/922; 5/89.1

[58] Field of Search ..... 5/81.1, 922, 89, 625, 5/627, 485, 496

[56] References Cited

U.S. PATENT DOCUMENTS

| | | | |
|---|---|---|---|
| 803,193 | 10/1905 | Richards | 5/627 |
| 1,334,901 | 3/1920 | Higdon | 5/81.1 |
| 3,284,816 | 11/1966 | Laubsch | 5/81.1 |
| 3,708,810 | 1/1973 | Merikallio | 5/628 |
| 4,124,908 | 11/1978 | Burns | 5/627 |
| 4,301,791 | 11/1981 | Franco | 128/89 R |
| 4,700,416 | 10/1987 | Johansson | 5/81 R |
| 4,716,607 | 1/1988 | Johansson | 5/81 R |
| 4,742,587 | 5/1988 | Dove | 5/627 |
| 4,970,738 | 11/1990 | Cole | 5/81.13 |
| 5,060,324 | 10/1991 | Marinberg | 5/81.1 |

FOREIGN PATENT DOCUMENTS

| | | | |
|---|---|---|---|
| 3107221 | 9/1982 | Fed. Rep. of Germany | 5/81.1 |
| 253404 | 6/1926 | United Kingdom | 5/485 |

*Primary Examiner*—Renee S. Luebke
*Assistant Examiner*—F. Saether
*Attorney, Agent, or Firm*—Zarley, McKee, Thomte, Voorhees & Sease

[57] ABSTRACT

A body transfer mat includes a generally rectangular sheet having a center support section and right and left wing portions extending from the center section. Each wing portion is foldable upon itself with fasteners to maintain the wings in the folded position, so that the wing portions will not drag on the floor when the sheet is supported on a conventional gurney. Handles are located on the underside of the sheet on each side of the central support section, and are used to pull a patient located on the sheet from a gurney to a separate table or bed. The wing portions include cooperable fasteners so as to enable the wing portions to be secured over the top of a patient during transfer of the patient on the sheet. Preferably, reinforcing straps are mounted on the upper surface of the central support section, through which the handles are fastened. In a second embodiment of the invention, a pair of wing portions are provided on each side of the central support section, to permit the transfer of large patients.

5 Claims, 5 Drawing Sheets

BODY TRANSFER MAT HAVING OPPOSING SELECTIVELY ENGAGEABLE WING PORTIONS FOR SECURING A PATIENT

TECHNICAL FIELD

The present invention relates generally to an apparatus for lifting and transferring bodies from one location to another, and more particularly to an improved body transfer mat for quick and simple shifting of a body.

BACKGROUND OF THE INVENTION

It has always been a problem to move a patient from the gurney of an emergency vehicle to a hospital bed. Normally the patient is unable to assist in the move, thereby requiring several attendants to physically lift and move the patient. This process must then be repeated each time the patient is moved to a separate area of the hospital. Obviously, each move of this type can potentially aggravate the patient's injuries, or cause injuries to any of the lifting attendants.

While there have been many devices utilized in the prior art in shifting a patient, they still suffer several drawbacks. Many prior art units utilize boards or other stretcher type units made of generally rigid material. Such units however require that the entire unit be lifted in order to move the board from one bed to another. Nor are such apparatus cleaned and reutilized or transported in an emergency vehicle.

Other transfer apparatus utilize a foldable flexible mat, which is clearly more convenient to utilize than a rigid board. However, prior art mats are not quickly and easily connected over the top of a patient, nor do they rest on an emergency vehicle gurney in an easily utilizable position.

It is therefore a general object of the present invention to provide an improved body transfer mat.

Another object is to provide an improved transfer mat which will lay on an emergency vehicle gurney ready for use.

Yet another object of the present invention is to provide a body transfer mat which may be quickly secured around the patient to assist in transferring the patient.

Yet a further object is to provide a body transfer mat which is economic to manufacture, simple to use, and refined in appearance.

These and other objects will be apparent to those skilled in the art.

SUMMARY OF THE INVENTION

The body transfer mat of the present invention includes a generally rectangular sheet having a center support section and right and left wing portions extending from the center section. Each wing portion is foldable upon itself with fasteners to maintain the wings in the folded position, so that the wing portions will not drag on the floor when the sheet is supported on a conventional gurney. Handles are located on the underside of the sheet on each side of the central support section, and are used to pull a patient located on the sheet from a gurney to a separate table or bed. The wing portions include cooperable fasteners so as to enable the wing portions to be secured over the top of a patient during transfer of the patient on the sheet. Preferably, reinforcing straps are mounted on the upper surface of the central support section, through which the handles are fastened. In a second embodiment of the invention, a pair of wing portions are provided on each side of the central support section, to permit the transfer of larger patients.

DESCRIPTION OF THE PREFERRED EMBODIMENTS

Figure 1:
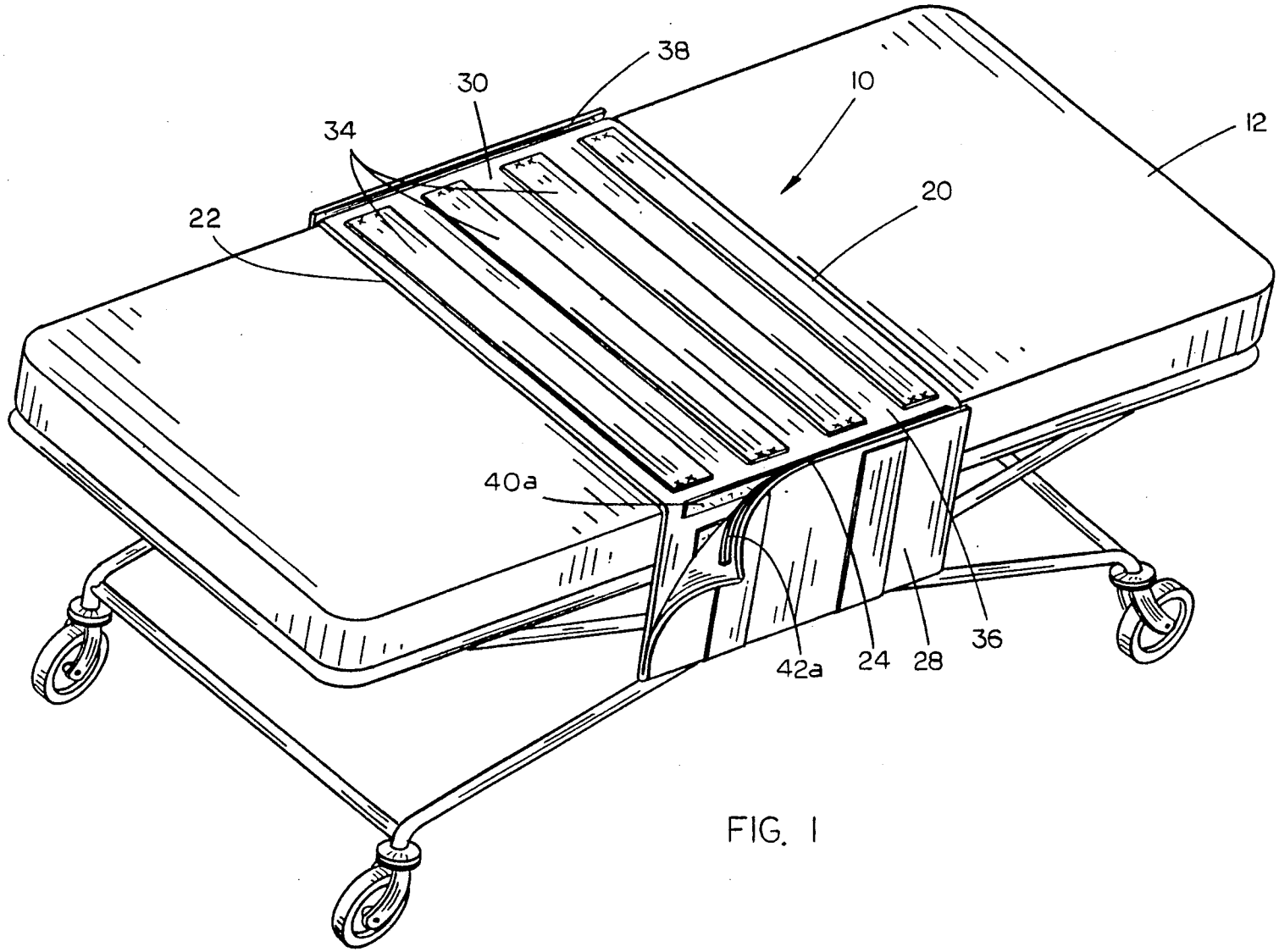
FIG. 1 is a perspective view of the transfer mat of the present invention resting on a conventional emergency vehicle gurney.

Referring now to the drawings, in which similar or corresponding parts are identified with the same reference numeral and more particularly to FIG. 1, the transfer mat of the present invention is identified generally at 10 and is designed to rest on top of an emergency vehicle gurney 12 or the like.

Figure 2:
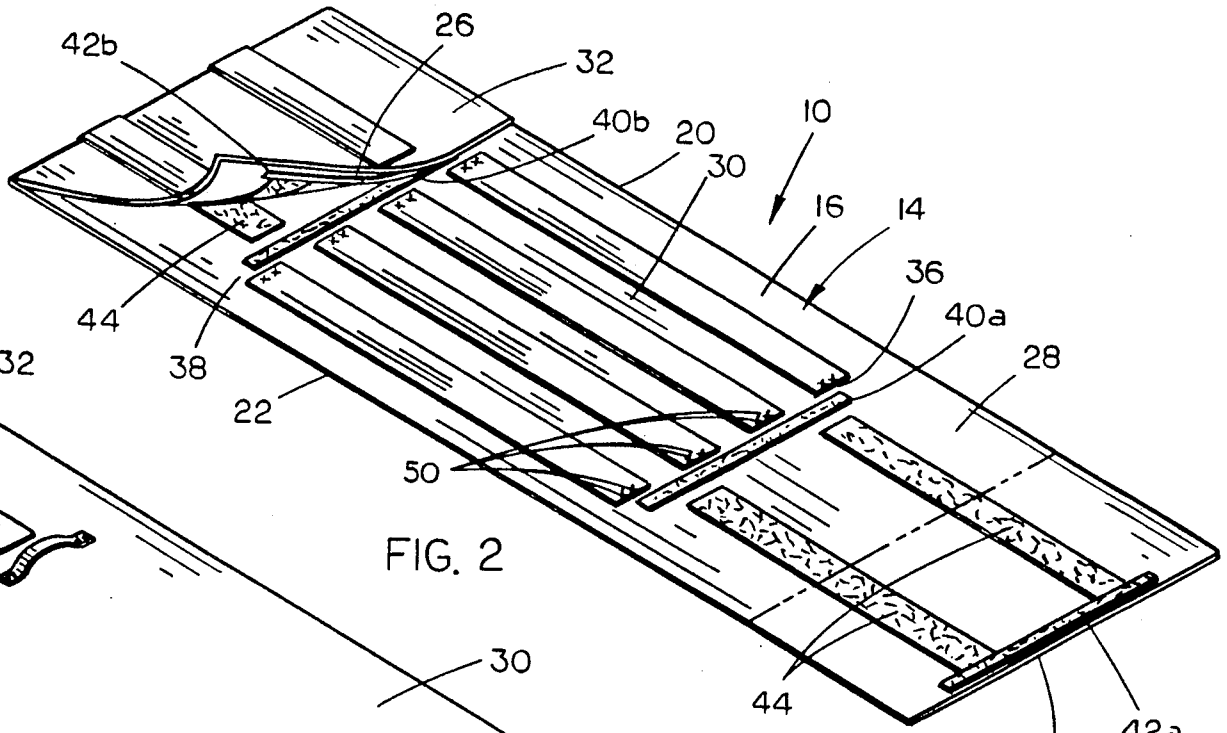
FIG. 2 is a perspective view of the top surface of a transfer mat.
Figure 3:
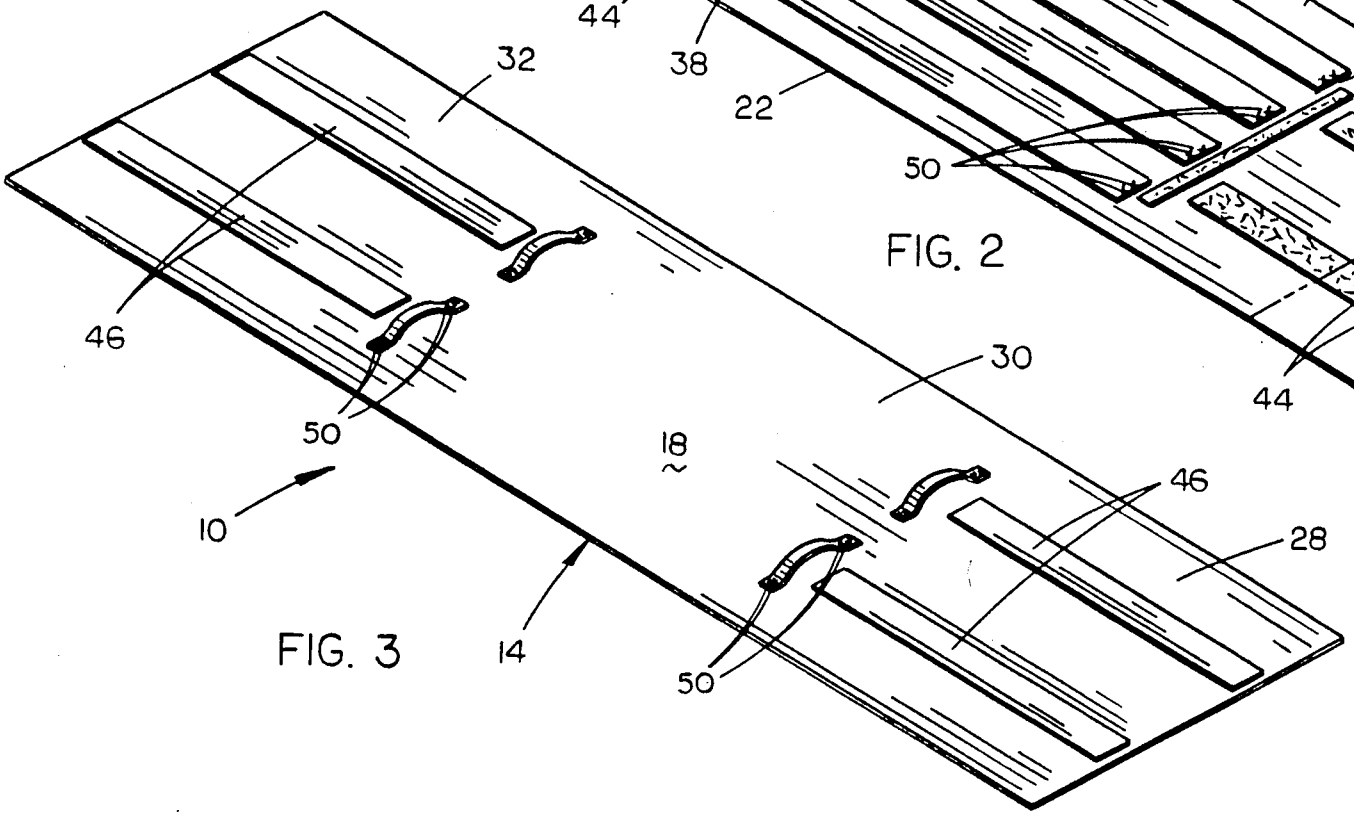
FIG. 3 is a perspective view of the bottom surface of the transfer mat.

Referring now to FIG. 2, mat 10 is a generally rectangular flexible fabric sheet 14 having an upper surface 16, a lower surface 18 (see FIG. 3), a forward longitudinal edge 20, a rearward longitudinal edge 22, a right end 24 and a left end 26. For ease of description, mat 10 may be described as consisting of three generally equal sections from right end 24 and to left end 26 consisting of a right wing portion 28, a central support section 30 and a left wing portion 32.

As shown in Figure central support section 30 is that portion of mat 10 which will lay across the width of gurney 12. A series of parallel spaced-apart reinforcing straps extend parallel to forward and rearward edges 20 and 22 across the entirety of central support section 30. The right and left edges 36 and 38 of central support section 30 have a strip of hook and loop fastener material 40 extending from rearward edge 22 to forward edge 20. Fastener strip **40*a* along right edge 36 corresponds with a second strip of hook and loop fastener material 42*a* fastened along right end 24 of mat 10, such that right wing portion 28 may be folded upon itself and fastened as shown in FIG. 1**.

Similarly, hook and loop fastener strip **40*b* along left edge 38 of central section 30 corresponds with a second hook and loop fastener strip 42*b* fastened along left edge 26 of mat 10, as shown in FIG. 2. The folding and fastening of right and left wing portions 28 and 32 permits the gurney 12 to be lowered to a storage position without mat 10** dragging on the ground.

The upper surface of right wing portion 28 includes two longitudinal straps 44 of loop fastener material. A similar pair of straps 44 of loop fastener material are mounted on left wing portion 32, as shown in FIG. 2. Straps 44 of loop material correspond with straps 46 of hook material on the rearward surface 18 of right and left wing portions 28 and 32, shown in FIG. 3.

The rearward surface 18 of central portion 30 includes four handles 48 mounted along the junction of center section 30 with right and left wing portions 28 and 32 respectively. Handles 48 are mounted to sheet 14 with fasteners 50. The location of reinforcing straps 34 on the upper surface of central section 30 is such that fasteners 50 extend through handles 48, sheet 14 and thence through reinforcing straps 34. In this way, straps 34 not only reinforce the supporting of a body on central section 30, but reinforce the fasteners 50 holding handles 48 in position.

Figure 4:
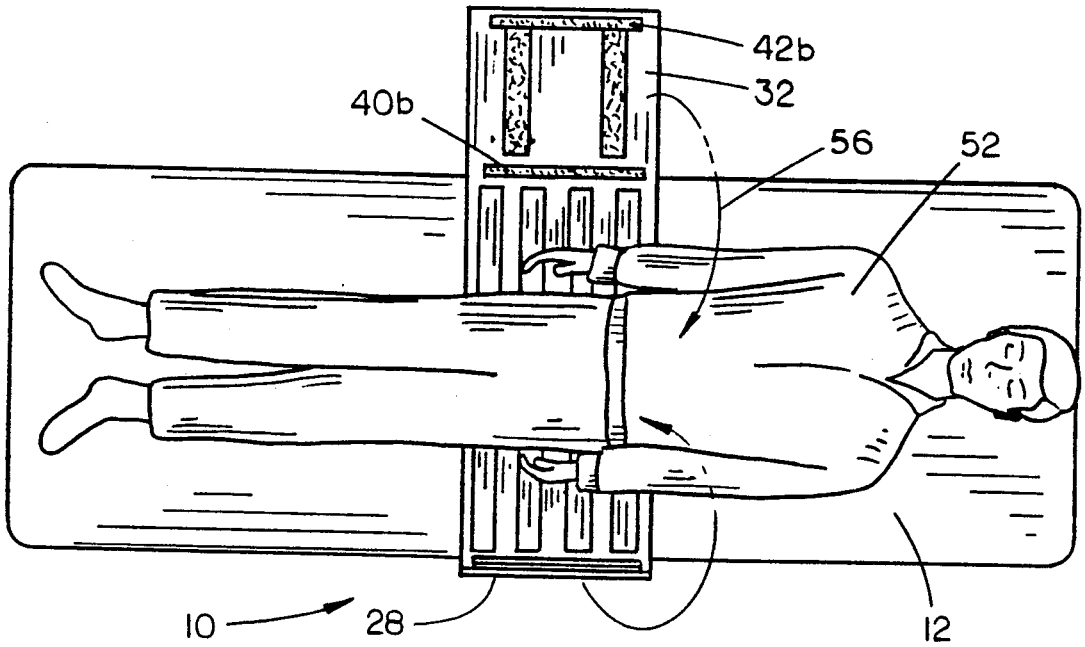
FIG. 4 is a top view of the mat with a person located thereon.
Figure 5:
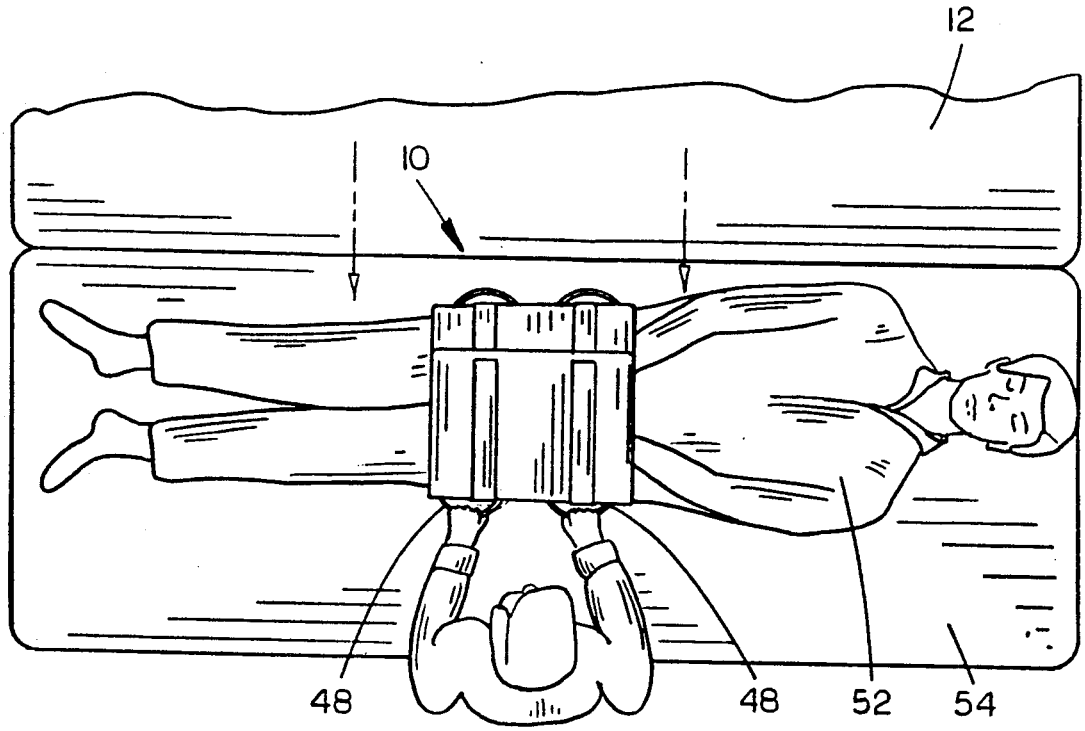
FIG. 5 is a view similar to FIG. 4 with the mat secured to the person transferring the person.

Referring now to FIG. 4, mat 10 is located on gurney 12 with left and right wing portions 32 and 28 draped over the side edges of the gurney 12. Right wing portion 28 is shown fastened in the folded position against the side of gurney 12, while left wing portion 32 is shown expanded to one side so as to be folded over the person 52 on gurney 12. In order to shift a patient from gurney 12 to a bed 54, as shown in FIG. 5, left wing portion 32 is extended by disconnecting strip **42*b* from strip 40*b* and draping it over patient 52 as shown by arrow 56. Wing portion 28 is then extended and laid over the top of wing portion 32 such that straps 46 on the back of wing 32 (see FIG. 3) connect with the straps 44 on the upper surface of right wing 28 (see FIG. 2). When secured to the person, as shown in FIG. 5, handles 48 are exposed to permit the easy shifting of patient 52 from gurney 12 to bed 54**.

Figure 6:
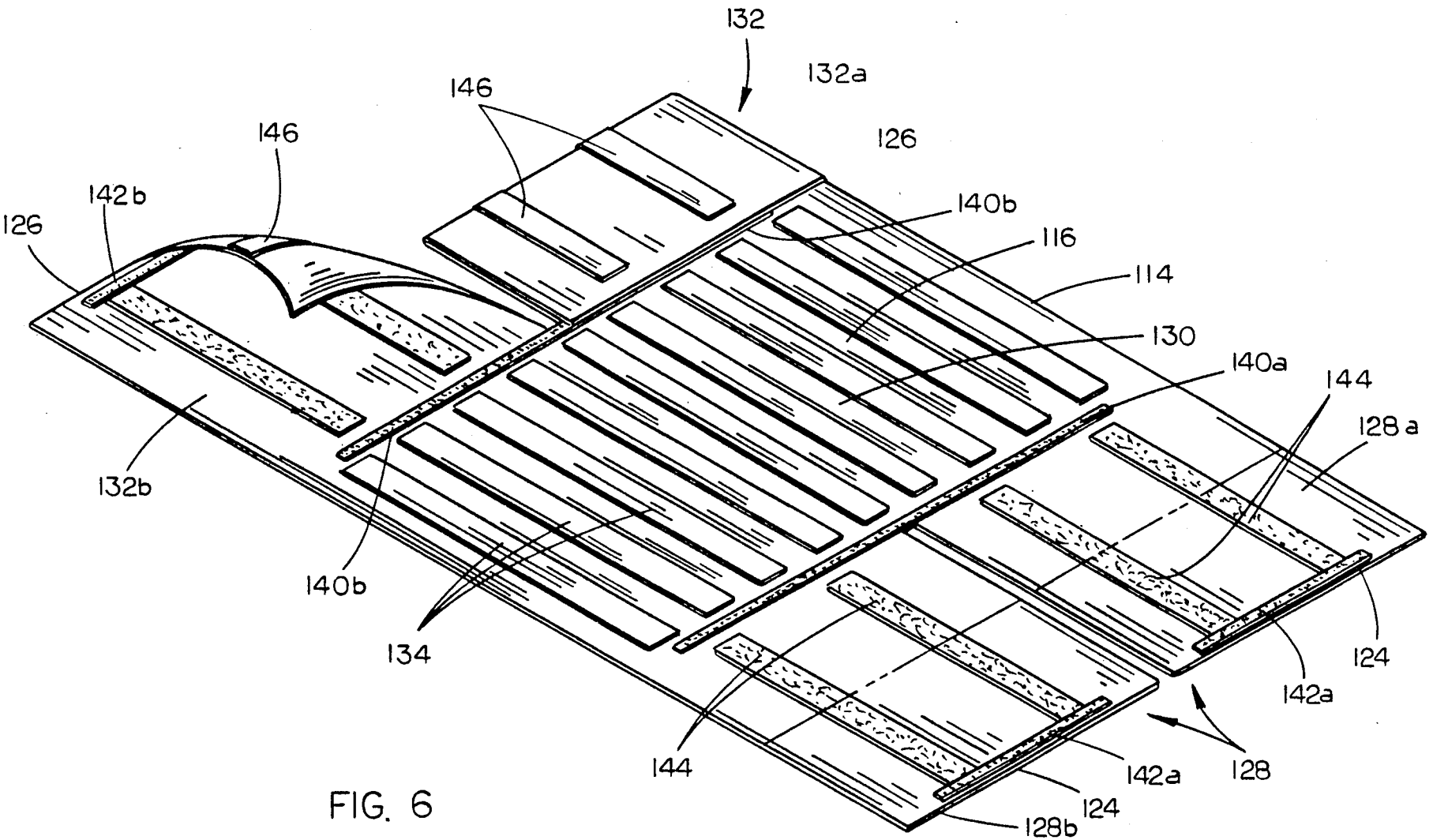
FIG. 6 is a perspective view of a second embodiment of the mat.

Referring now to FIG. 6, a second embodiment of the invention is designated generally at 110 and includes a sheet 114 having upper and lower surfaces 116 and 118, forward and rearward edges 120 and 122 and right and left ends 124 and 126. Similar to the first embodiment, mat 110 includes a right wing portion 128 central support section 130 and left wing portion 132. The main difference in the second embodiment 110 is in the additional length of the mat between the forward and rearward edges 120 and 122. This permits the division of right and left wing portions 128 and 132 into forward and rearward flaps **128*a* and 128*b* in right wing portion 128, and forward and rearward flaps 132*a* and 132*b* in left wing portion 132. Reinforcing straps 134, hook and loop fastener strips 140, second strips 142, straps 144 and straps 146 are all the same as the first embodiment of mat 10**.

Figure 7:
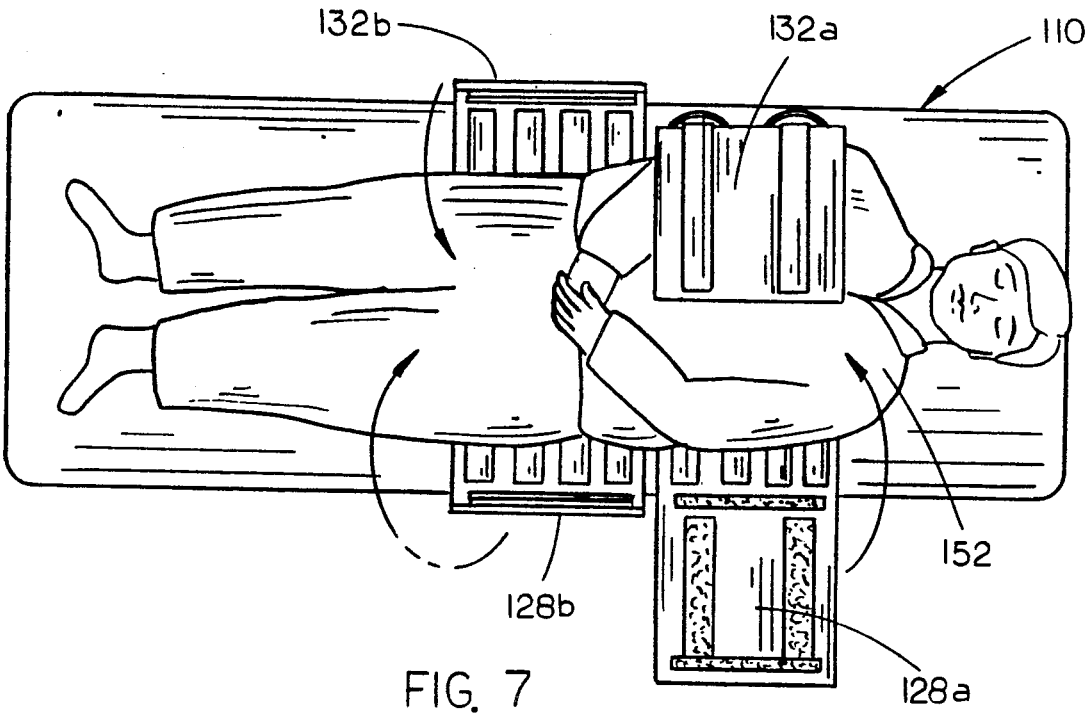
FIG. 7 is a top view of the mat of FIG. 6 with a person thereon.
Figure 8:
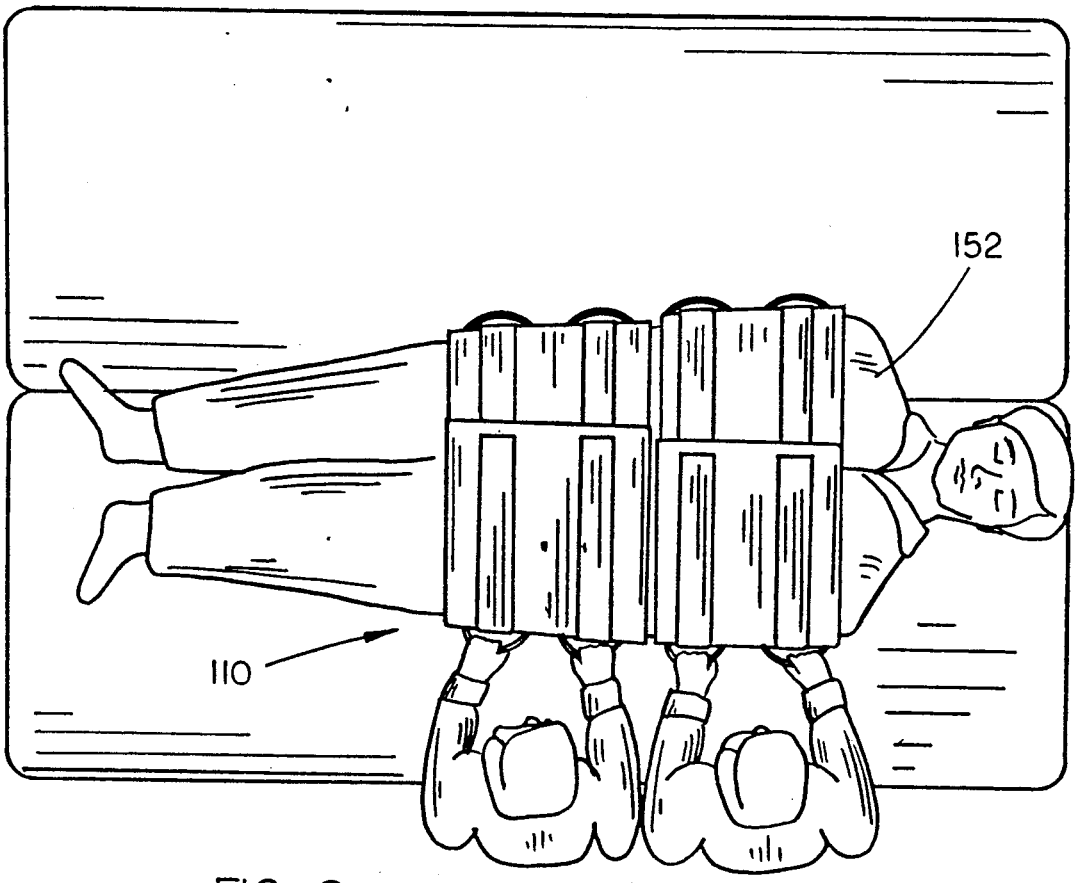
FIG. 8 is a top view of the mat of FIG. 6 utilized to shift a person from a gurney to a bed.

As shown in FIG. 7, mat 110 permits lower flaps **128*b* and 132*b* to be wrapped about the hips of a patient 152, while the forward flaps 128*a* and 132*a* may be wrapped about the shoulders of a patient 152. For large patients, this permits better positioning of mat 110, as shown in FIG. 8**, to permit two attendants to shift the patient.

Whereas the invention as been shown and described in connection with the preferred embodiments thereof, it will be understood that many modifications, substitutions and additions may be made which are within the intended broad scope of the appended claims. There has therefore been shown and described an improved body transfer mat which accomplishes at least all of the above stated objects.

I claim:

1. A body transfer mat, comprising:

a generally rectangular sheet having forward and rearward edges, right and left ends, and upper and lower surfaces;

said sheet defined by a center support section extending from the forward to the rearward edge and having right and left edges intermediate the right and left ends of the sheet;

said sheet further defined by a right wing portion extending from the center section to the right end, and a left wing portion extending from the center section to the left end;

said right wing portion including means for selectively connecting the right end to a position adjacent a right edge such that the right wing portion is folded upon itself when connected;

said left wing portion including means for selectively connecting the left end to a position adjacent the left edge, such that the left wing portion is folded upon itself when connected;

means for selectively connecting said right and left wing portions together in overlapping position over the upper surface of the center section, to secure a patient on the center section; and handles on said sheet located along the right and left edges of the center support section and located to be grasped from the lower surface of the sheet.

2. The mat of claim 1, wherein said means for selectively connecting said right and left wing portions includes a first half of a cooperable fastener mounted on the lower surface of said right wing portion, and a second half of a cooperable fastener mounted on the upper surface of said left wing portion, such that said first and second halves will selectively cooperably fasten when the right wing portion is overlapped on top of the left wing portion on top of the center section.

3. The mat of claim 2, wherein said means for selectively connecting said right and left wing portions further comprises a first half of a cooperable fastener mounted on the lower surface of said left wing portion and a second half of a cooperable fastener mounted on the upper surface of said right wing portion.

4. The mat of claim 1, further comprising a plurality of reinforcing straps mounted on the upper surface of said center section and extending from the left edge to the right edge of said center section, for supporting a patient thereon.

5. The mat of claim 4, wherein said handles include:

first and second handles fastened to the lower surface of said sheet along the right edge of the center support section;

third and fourth handles fastened to the lower surface of the sheet along the left edge of the center support section; and each said first, second, third and fourth handles including a strap with opposing ends, and fastener means fastened through each end of each handle and through said sheet and thence through one of said reinforcing straps to be secured thereto.

* * * * *